United States Patent [19]

Galvin et al.

[11] 3,938,118

[45] Feb. 10, 1976

[54] MULTIZONE INTRUSION ALARM SYSTEM

[75] Inventors: Aaron A. Galvin, Lexington; L. Dennis Shapiro, Lincoln, both of Mass.

[73] Assignee: American District Telegraph Company, New York, N.Y.

[22] Filed: June 12, 1974

[21] Appl. No.: 478,526

[52] U.S. Cl. ..... 340/258 R; 340/16 R; 340/258 A

[51] Int. Cl.[2] ..... G08B 13/24; G08B 13/16

[58] Field of Search ..... 340/258 R, 258 A, 258 B, 340/258 D, 261, 16 R, 147 LP

[56] References Cited

UNITED STATES PATENTS

| | | | |
|---|---|---|---|
| 3,264,613 | 8/1966 | Stolle | 340/147 LP |
| 3,626,365 | 12/1971 | Press et al. | 340/16 R |
| 3,680,074 | 7/1972 | Lieser | 340/258 A |
| 3,747,057 | 7/1973 | Brougher | 340/16 R |
| 3,781,859 | 12/1973 | Hermans | 340/258 A |

*Primary Examiner*—David L. Trafton

*Attorney, Agent, or Firm*—Weingarten, Maxham & Schurgin

[57] ABSTRACT

An intrusion alarm system for use with a plurality of protected zones and providing an output indication of a particular zone or zones in which intrusion has occurred. A lesser number of signal processors are employed than the number of zones being protected. Signals received from each protected zone are selectively combined to provide different summed signals which are applied to respective processors that are shared by the zones and the output signals of which are processed by logic circuitry to provide an output indication of the presence of an intruder and an indication of the zone in which intrusion has occurred.

6 Claims, 3 Drawing Figures

| FIRST ALARM | | SECOND ALARM | |
|---|---|---|---|
| | | PROC A | PROC B |
| | PROC A | 1 | 2 |
| | PROC B | 3 | 4 |

MULTIZONE INTRUSION ALARM SYSTEM

FIELD OF THE INVENTION

This invention relates to intrusion alarm systems and more particularly to systems for detection of intruders in one or more multiple zones and for providing an indication of the zones in which intrusion occurs.

BACKGROUND OF THE INVENTION

Systems are known for detection of intrusion within a protected zone. Many such systems employ Doppler techniques in which a signal is propagated within a zone under surveillance, and signals returned from the zone and from objects therein processed to determine intruder presence by a Doppler signal detectable as an indication of intruder presence. A major requirement of all practical intrusion alarm systems is the reliable discrimination between an actual intruder and noise or other spurious conditions which could give rise to a false alarm indication of intrusion. Sophisticated electronic signal processing circuits have been developed for providing such discrimination, and such processors are a relatively expensive portion of an overall system. For many installations, multiple zones are under surveillance and a common signal processor is employed to receive signals from each of the zones. However, this type of system will provide an alarm when any zone is intruded, but the alarm will not be indicative of the particular zone in which intrusion has occurred. In order to provide identification of the particular zone being intruded, systems of conventional construction employ individual signal processors for each zone, which can materially add to the cost and complexity of an installed system.

SUMMARY OF THE INVENTION

According to the present invention, a multiple zone intrusion alarm system is provided in which a lesser number of signal processors is employed than the number of zones being protected. Signals received from each protected zone are selectively combined to provide different summed signals which are applied to respective processors operative to discriminate between an actual intruder and spurious signal conditions such as noise and to provide an output signal indicative of intruder presence. The output signals of the signal processors are further processed by logic circuitry to derive output signal indications corresponding to respective zones, and which are operative to energize output indicators denoting an alarm condition in the respective zones. The signal processors are a relatively expensive portion of an overall alarm system, and by virtue of the invention a greater number of zones is protectable by a relatively lesser number of signal processors to achieve an economical system. The invention is also useful in denoting a particular one of a number of zones in which a false alarm has occurred to identify the zone requiring corrective action.

DESCRIPTION OF THE DRAWINGS

The invention will be more fully understood from the following detailed description taken in conjunction with the accompanying drawings in which.

DETAILED DESCRIPTION OF THE INVENTION

Figures 1, 3:
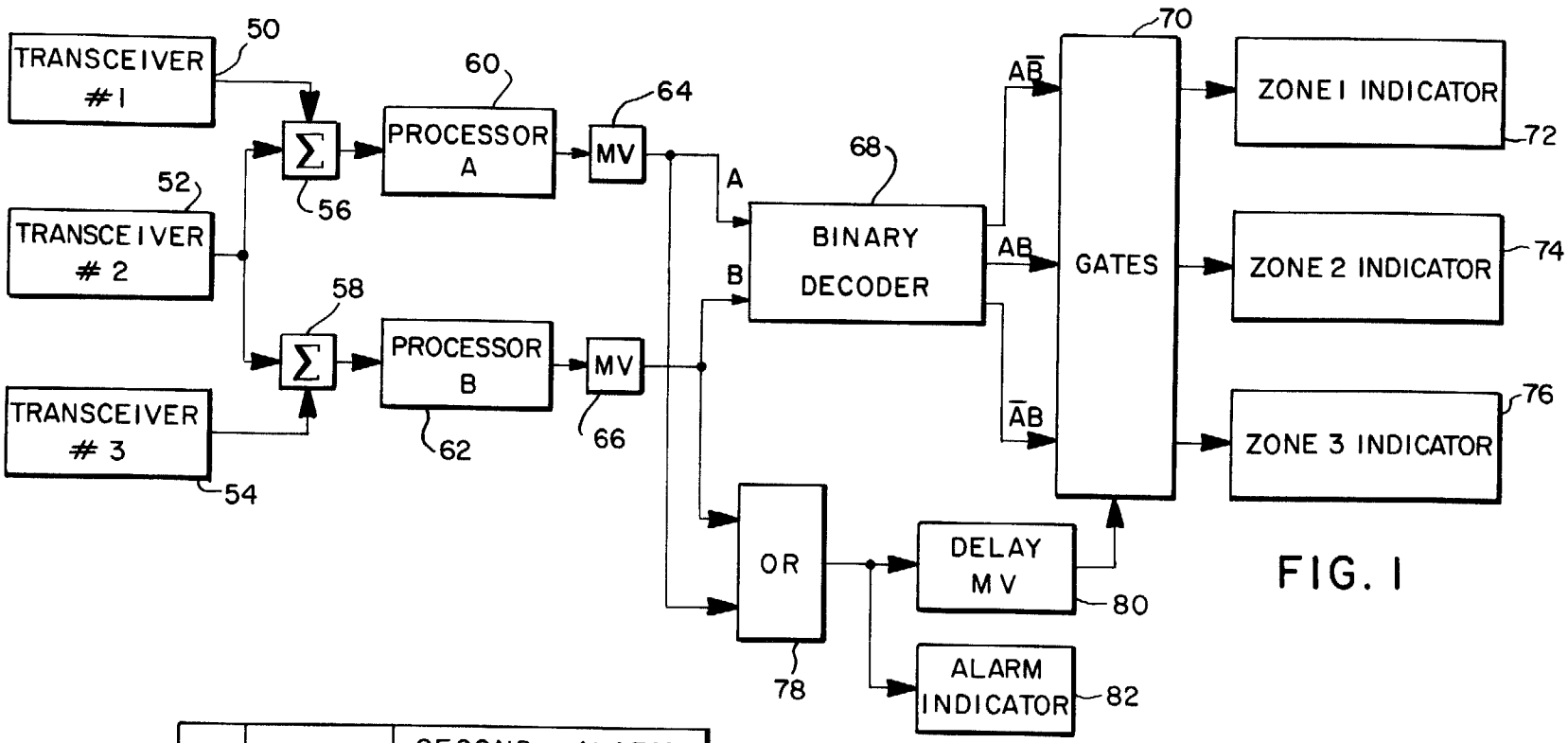
FIG. 1 is a block diagram representation of an embodiment of the invention.
FIG. 3 is a table useful in illustrating operation of the embodiment of FIG. 2.

Referring to FIG. 1 of the drawing, there is shown a system for the surveillance of a plurality of zones being protected and for an indication of the particular zone or zones in which intrusion occurs. A plurality of transceivers 50, 52 and 54 is provided, each being disposed in a respective zone under surveillance and each typically including a transmitting transducer for propagating ultrasonic, electromagnetic or other suitable energy into the zone, a receiving transducer for receiving energy returned from the zone and from objects therein, and a preamplifier for amplifying the signals provided by the receiving transducer in response to returned energy. The receiver signals in the presence of an intruder moving within a surveillance zone contain Doppler information representative of intruder presence and these signals are conveyed typically via interconnecting wiring to processing circuitry usually located remote from the transceivers and operative to discriminate actual intruders from noise or other spurious signal conditions and to provide an output indication of intruder presence. A three zone system is illustrated, but it will be appreciated that the invention is equally applicable to any number of zones.

In the embodiment of FIG. 1, N signal processors are employed for $2^N - 1$ zones; thus a lesser number of processors is employed than the number of protected zones. For example, two processors can serve three zones, four processors can serve fifteen zones, etc. The signal processors provide discrimination between an actual intruder and noise or spurious signal conditions that could otherwise cause a false alarm indication. A signal processor of preferred implementation is shown in U.S. Pat. No. 3,665,443 assigned to the assignee of this invention. Referring to FIG. 1, the receiver output of transceiver 50 is coupled to one input of a summing circuit 56, while the receiver output of transceiver 54 is coupled to one input of a summing circuit 58. The receiver output of transceiver 52 is coupled to the second input of circuits 56 and 58, the output of which is coupled to respective signal processors 60 and 62. The output of processors 60 and 62 are coupled to respective multivibrators 64 and 66, the outputs of which are coupled to respective inputs of a binary decoder 68. The outputs of decoder 68 are coupled to a gate 70, the outputs of which are applied to zone indicators 72–76 which respectively denote the particular zone in which intrusion occurs. The outputs of multivibrators 64 and 66 are also applied to an OR gate 78, the output of which provides an output indication of an alarm condition in one of the zones but without indication of which particular zone. The output of OR gate 78 is also coupled via a delay circuit 80 to gate 70 as an enable signal therefor.

The signal processors 60 and 62 provide output signals in accordance with the particular input signals received from transceivers 50, 52 and 54. The multivibrators 64 and 66 provide short-term storage of the signals applied thereto by the corresponding processors such that signals are applied in a substantially simultaneous manner to decoder 68 and to OR gate 78 for subsequent processing. The decoder 68 provides output signals in accordance with the logical combination of input signals applied thereto. With the signals applied to decoder 68 from processors 60 and 62 labelled A and B respectively, the logical designation of the output signals from decoder 68 are as illustrated in FIG. 1. An output signal on the uppermost line of decoder 68 is provided in response to a signal from transceiver 50, while an output signal on the lowermost output line of decoder 68 is provided in response to a signal from transceiver 54. Signals from transceiver 52 cause provision of an output signal at the middle decoder output line. Simultaneous receipt of returned signals from more than one zone can give rise to an incorrect zone indication. However, in practice simultaneous receipt of returned signals indicating simultaneous intrusion in a plurality of zones is quite unlikely to occur.

The output signals from decoder 68 are coupled by means of gate 70, enabled by the signal from multivibrator 80, to respective zone indicators 72–76. Actuation of a particular zone indicator thus denotes the particular zone in which intrusion is detected. If desired, an output alarm indication can also be provided by the output signal from OR gate 78, with the specific zone information provided by indicators 72–76.

Figure 2:
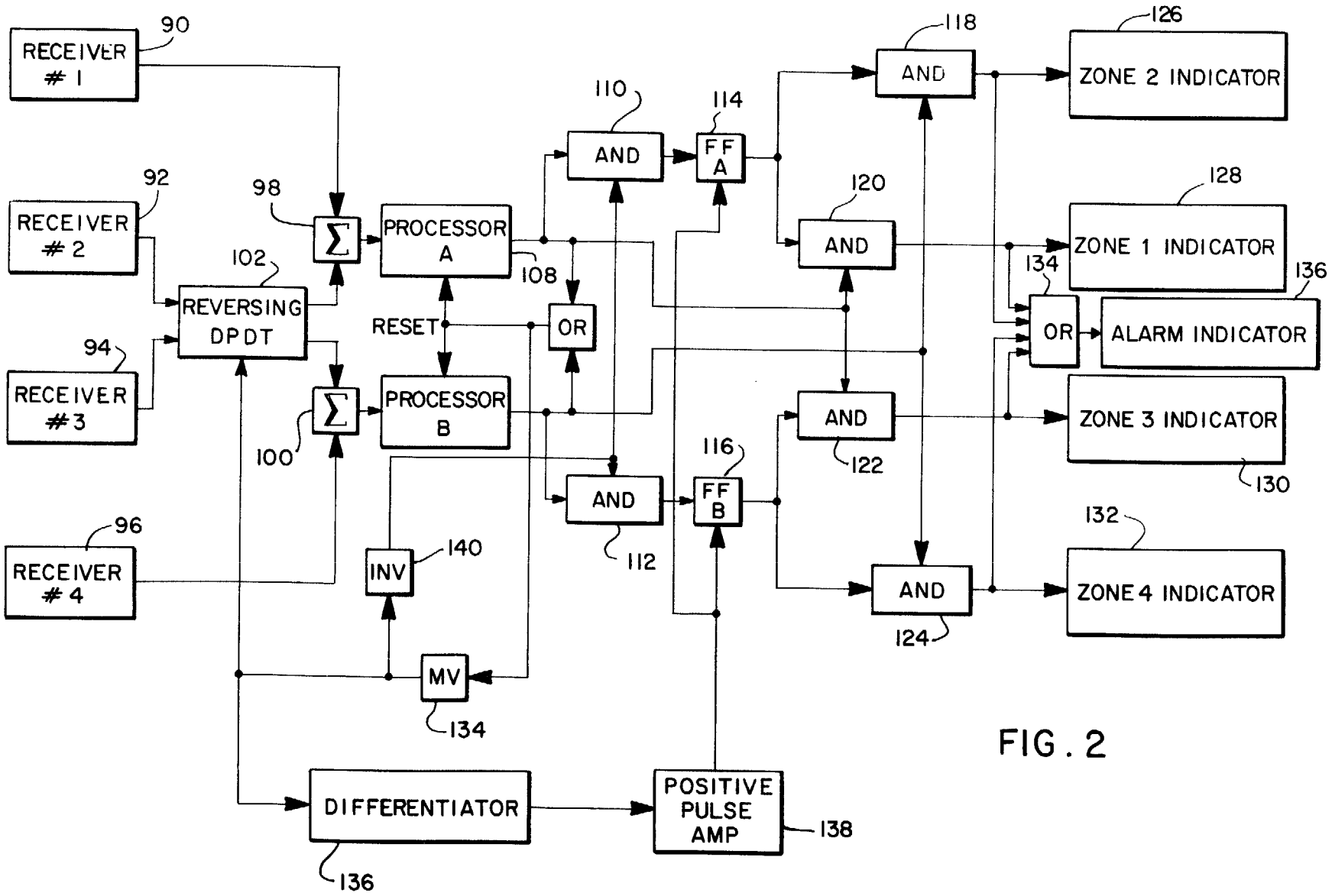
FIG. 2 is a block diagram representation of an alternative embodiment of the invention.

An alternative embodiment of the invention is shown in FIG. 2 for providing coverage of $N^2$ zones with N signal processors. Transceivers 90 and 96 are coupled to respective summing circuits 98 and 100, while transceivers 92 and 94 are coupled to a double pole, double throw switching circuit 102, the outputs of which are coupled to respective summing circuits 98 and 100. The summing circuits 98 and 100 are coupled to respective processors 104 and 106, the outputs of which are coupled to an OR gate 108 and to one input of respective AND gates 110 and 112. The AND gates are coupled to respective flip-flops 114 and 116 which, in turn, are coupled to AND gates 118 and 120, and AND gates 122 and 124, respectively. Processor 104 is coupled to gates 120 and 122, while processor 106 is coupled to gates 118 and 124.

The outputs of the AND gates 118–124 are applied to respective zone indicators 126, 128, 130 and 132, and are also applied to an OR gate 134, the output of which provides a system alarm indication. The output of OR gate 108 is applied as a reset signal to processors 104 and 106, and is also applied to a multivibrator 134, the output of which is applied to switch 102 and differentiator 136. The differentiator output is applied to a pulse amplifier 138, the output signal of which provides a reset signal to flip-flops 114 and 116. The output from monostable multivibrator 134 is also applied via an inverter circuit 140 to AND gates 110 and 112.

The embodiment of FIG. 2 is operative in a sequential manner to derive an output indication of the particular zone in which intrusion has occurred. Initially, the receivers of transceivers 90 and 92 are coupled to processor 104 while the receivers of transceivers 94 and 96 are coupled to processor 106. Processor 104 provides an output signal in response to intruder detection by transceiver 90 or 92, while processor 106 provides an output signal upon intrusion detection by transceivers 94 or 96. The output signals from processors 104 and 106 are conveyed by means of respective AND gates 110 and 112 to respective flip-flops 114 and 116. The AND gates 110 and 112 are enabled except for the duration of the gating signal from multivibrator 134. Thus, the output signal from processors 104 or 106 sets the respective flip-flops 114 and 116 to provide a stored indication of which processor has detected an intrusion condition. After flip-flops 114 or 116 are set, the corresponding processors 104 and 106 are reset by a signal provided by OR gate 108. This reset signal also energizes multivibrator 134 which generates a gating signal operative to energize switch 102 and also operative to disable AND gates 110 and 112 by way of the signal from inverter 140.

Activation of switch 102 effectively reverses the outputs of transceivers 92 and 94 such that processor 104 receives signals from transceivers 90 and 94, while processor 106 receives signals from transceivers 92 and 96. With the intruder still present in a particular zone, processors 104 and 106 will provide output signals in accordance with the particular zone in which intrusion is now detected. As shown in the table of FIG. 3, the particular zone in which intrusion has occurred is identified by correlation of the output signals from processors 104 and 106 during both stages of the detection sequence. In the table, processors 104 and 106 are identified by the letters A and B, respectively. If processor A provides an output signal during both the first and second alarm detections, intrusion has occurred in zone 1 associated with transceiver 90. If processor A provides an output signal during the first alarm detection and processor B provides an output signal during the second alarm detection, then zone 2 associated with transceiver 92 has been intruded. Zone 4 associated with transceiver 96 is intruded if processor B provides an output signal during both detection stages. If processor B provides intruder detection during the first detection stage while processor A provides an output signal during the second detection stage, then zone 3 associated with transceiver 94 has been intruded.

The decoding of the processor output signals is provided by AND gates 118–124. The flip-flops 114 and 116, which have been set by a corresponding processor output signal, enable respective ones of the AND gates 118–124. The processor output signals provided during the second detection stage are applied to the AND gates illustrated. The gates 118–124 receiving both a signal from flip-flop 114 or 116 and a signal from processor 104 or 106 provide an output signal representative of the particular zone in which intrusion has occurred and which signal actuates a corresponding zone alarm indicator 126–132. At the end of the gating signal from multivibrator 134, which determines the time during which the second detection stage occurs, a differentiator 136 is triggered which provides, by means of posistive pulse amplifier 138, a reset pulse for resetting flip-flops 114 and 116 to place the circuit in condition for a subsequent detection cycle. Thus, the embodiment of FIG. 2 is operative in a sequential manner to provide a first intruder indication in response to a first set of input signals applied to processors 104 and 106, and a second intruder indication in response to a second set of input signal conditions. An alarm condition as detected during the first portion of the sequential detection sequence is stored by flip-flops 114 and 116, and the alarm indication as detected by the second portion of the sequential detection sequence is provided as a signal to the decoding gates 118–124 which are selectively enabled by the signal from flip-flops 114 and 116 to provide a decoded output signal representative of the intruded zone.

It will be appreciated that the invention is useful with a variety of intrusion alarm systems which can be of the Doppler or other type as well as being active or passive. The invention can also be variously inplemented to suit specific system requirements, and it is not intended therefore to limit the invention by what has been particularly shown and described except as indicated in the appended claims.

What is claimed is:

1. A multiple zone intrusion alarm system comprising:

a plurality of transmitting and receiving means each disposed in a respective zone under protection and each including means for propagating a signal in said zone and means for receiving signals returned from said zone and from objects therein;

means for selectively combining said returned signals to provide a plurality of differently combined signal versions thereof, said signal versions being less in number than the number of zones being protected;

a plurality of signal processors of a lesser number than the number of zones under protection and each operative to discriminate between an actual intruder and spurious signal conditions, each signal processor receiving a respective one of said signal versions and providing an output signal in response thereto; and decoder means operative in response to said output signals from said signal processors to provide a plurality of signals each corresponding to a respective protected zone and each representative of intruder presence in said zone.

2. A multiple zone intrusion alarm system according to claim 1 wherein said selectively combining means includes:

switching means coupled to selected ones of said receiving means and operative in one state to convey said returned signals from said selected ones of said receiving means to first respective ones of said signal processors and operative in a second state to convey said returned signals to different respective ones of said signal processors.

3. A multiple zone intrusion alarm system according to claim 2 wherein said decoder means includes:

means operative during the first state of said switching means for storing a representation of the identity of the signal processor providing an output signal representing intruder presence;

gating means operative during the second state of said switching means for providing in response to a signal processor output signal and a signal from said storage means an output signal indication of the zone in which intrusion is detected.

4. A multiple zone intrusion alarm system according to claim 3 wherein said gating means includes:

a plurality of AND gates, respective first pairs thereof receiving a signal from respective ones of said storage means and respective second pairs thereof receiving a signal from a respective one of said signal processors, and each providing said output signal indication.

5. A multiple zone intrusion alarm system according to claim 1 wherein said decoder means includes:

a binary decoder operative in response to said output signals from said signal processors to provide a plurality of signals representing different combinations of said returned signals;

gating means operative in response to said different combinations to provide said signals representative of intruder presence in particular zones.

6. For use in an intrusion alarm system having in each of a plurality of protected zones means for receiving signals from said zone and from objects therein, said signals containing information representative of intruder presence in said zone, circuitry for providing an output indication of a zone in which intrusion occurs, said circuitry comprising:

means for selectively combining said returned signals to provide a plurality of differently combined signal versions thereof, said signal versions being less in number than the number of said protected zones;

a plurality of signal processors equal in number to the number of said signal versions and each operative to discriminate between an actual intruder and spurious signal conditions, each signal processor receiving a respective one of said signal versions and providing an output signal in response thereto; and decoder means operative in response to said output signals from said signal processors to provide a plurality of signals each corresponding to a respective one of said protected zones and each representative of intruder presence in said zone.

* * * * *